US007190283B1

(12) United States Patent
Varian

(10) Patent No.: US 7,190,283 B1
(45) Date of Patent: Mar. 13, 2007

(54) INTERSECTION SAFETY LIGHT ASSEMBLY AND METHOD

(76) Inventor: Dean W. Varian, 6303 Mapleton St. South East, East Canton, OH (US) 44730

( * ) Notice: Subject to any disclaimer, the term of this patent is extended or adjusted under 35 U.S.C. 154(b) by 181 days.

(21) Appl. No.: 10/944,554

(22) Filed: Sep. 20, 2004

(51) Int. Cl.
*G08G 1/09* (2006.01)

(52) U.S. Cl. ..... 340/905; 340/903; 340/436

(58) Field of Classification Search ..... 340/905, 340/903, 917, 919, 933, 907, 436; 701/117
See application file for complete search history.

(56) References Cited

U.S. PATENT DOCUMENTS

| | | | | |
|---|---|---|---|---|
| 4,736,186 | A | 4/1988 | Jones | |
| 4,843,337 | A | 6/1989 | Conn, Jr. et al. | |
| D327,029 | S | 6/1992 | Porter | |
| 5,448,219 | A | 9/1995 | Yoshikawa et al. | |
| 5,497,148 | A | 3/1996 | Oliva | |
| 5,734,339 | A * | 3/1998 | Ogle | 340/944 |
| 5,940,010 | A | 8/1999 | Sasaki et al. | |
| 6,005,491 | A | 12/1999 | Kopchak et al. | |
| 6,243,644 | B1 * | 6/2001 | Dengler | 701/117 |
| 6,307,484 | B1 | 10/2001 | Sasaki et al. | |
| 6,816,086 | B1 * | 11/2004 | Kieffer, Sr. | 340/933 |

* cited by examiner

*Primary Examiner*—Phung T. Nguyen

(57) ABSTRACT

An intersection safety light assembly and method for warning a driver of a vehicle on a first road of an approaching vehicle on a second road which is approaching an intersection of the first and second roads. The method includes a housing that has a peripheral wall and a top wall. The housing is mounted adjacent to the intersection and is positioned such that a clear line of sight exists between the housing and a blind spot of the intersection and between the blind spot and the first road. A motion detector is mounted on the peripheral wall and is directed toward the blind spot. A light emitter is mounted on the peripheral wall and is directed toward the first road. The light emitter is electrically coupled to the motion detector and is turned on by the motion detector when motion is detected in the blind spot. A power supply is electrically coupled to the motion detector.

6 Claims, 5 Drawing Sheets

INTERSECTION SAFETY LIGHT ASSEMBLY AND METHOD

BACKGROUND OF THE INVENTION

1. Field of the Invention

The present invention relates to warning light devices and more particularly pertains to a new warning light device for warning vehicles of oncoming vehicles approaching from a blind spot in an intersection.

2. Description of the Prior Art

The use of warning light devices is known in the prior art. U.S. Pat. No. 4,736,186 describes an emergency warning light to warn people of an approaching emergency vehicle. Another type of warning light device is U.S. Pat. No. 6,005,491 which includes a traffic light that is operated by a motion detector which detects the approaching of a vehicle toward an intersection. Another such device is shown in U.S. Pat. No. 5,448,219 which includes a detector positioned away from an intersection which provides a signal to a warning light in the intersection when the detector detects an approaching vehicle.

While these devices fulfill their respective, particular objectives and requirements, the need remains for a device that is more portable and easier to use than previous warning systems. In particular, the device should be a signal unit including both a detection means and a warning light wherein the signal unit may be positioned so that the warning light is visible in one direction while the detection means detects motion in another direction.

SUMMARY OF THE INVENTION

The present invention meets the needs presented above by generally comprising a method for warning a driver of a vehicle on a first road of an intersection of an approaching vehicle on a second road of the intersection. The method includes a housing that has a peripheral wall and a top wall. The housing is mounted adjacent to the intersection and is positioned such that a clear line of sight exists between the housing and a blind spot of the intersection and between the blind spot and the first road. A motion detector is mounted on the peripheral wall and is directed toward the blind spot. A light emitter is mounted on the peripheral wall and is directed toward the first road. The light emitter is electrically coupled to the motion detector and is turned on by the motion detector when motion is detected in the blind spot. A power supply is electrically coupled to the motion detector.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
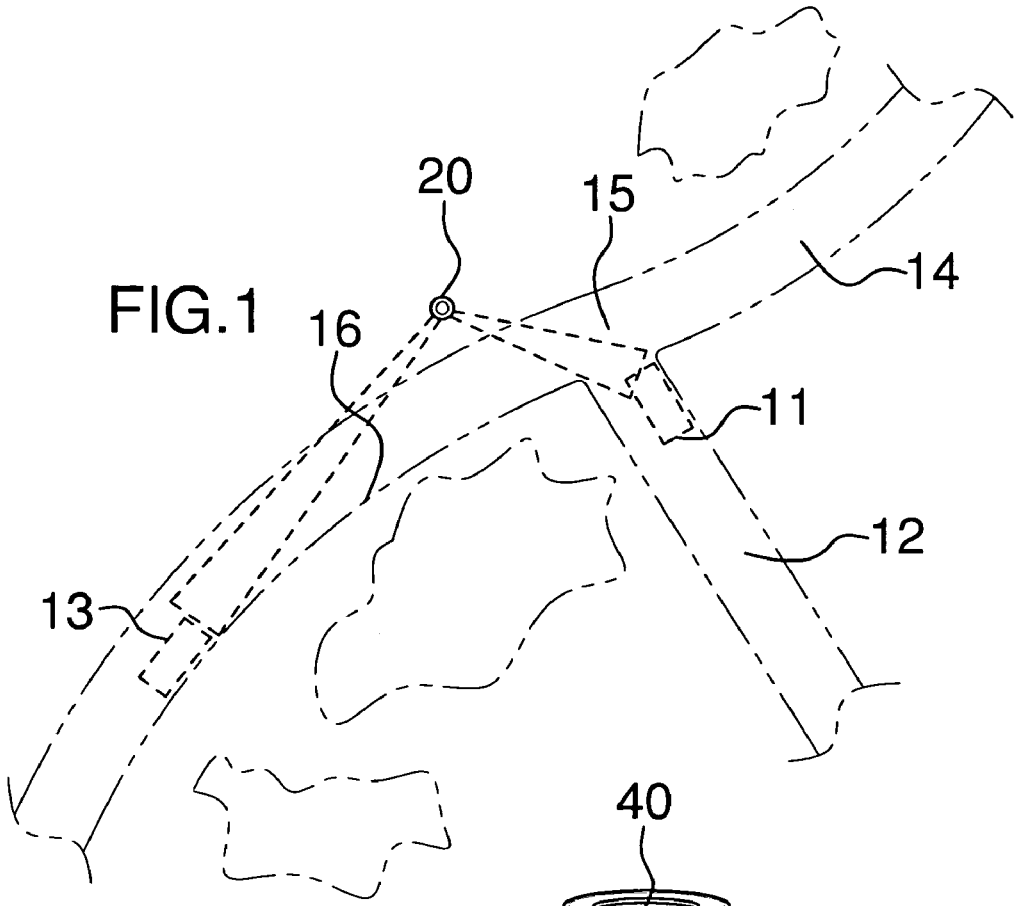
FIG. 1 is a schematic in-use view of a intersection safety light assembly and method according to the present invention.
Figure 2:
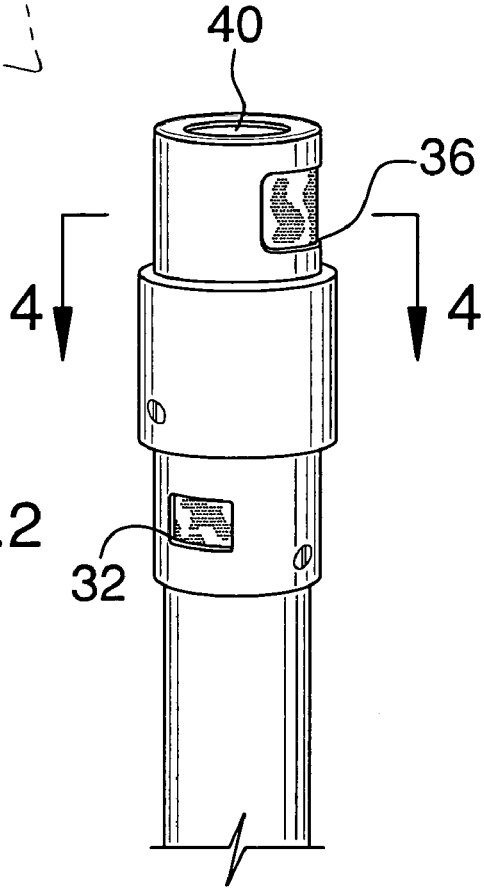
FIG. 2 is a front perspective view of the present invention.
Figure 3:
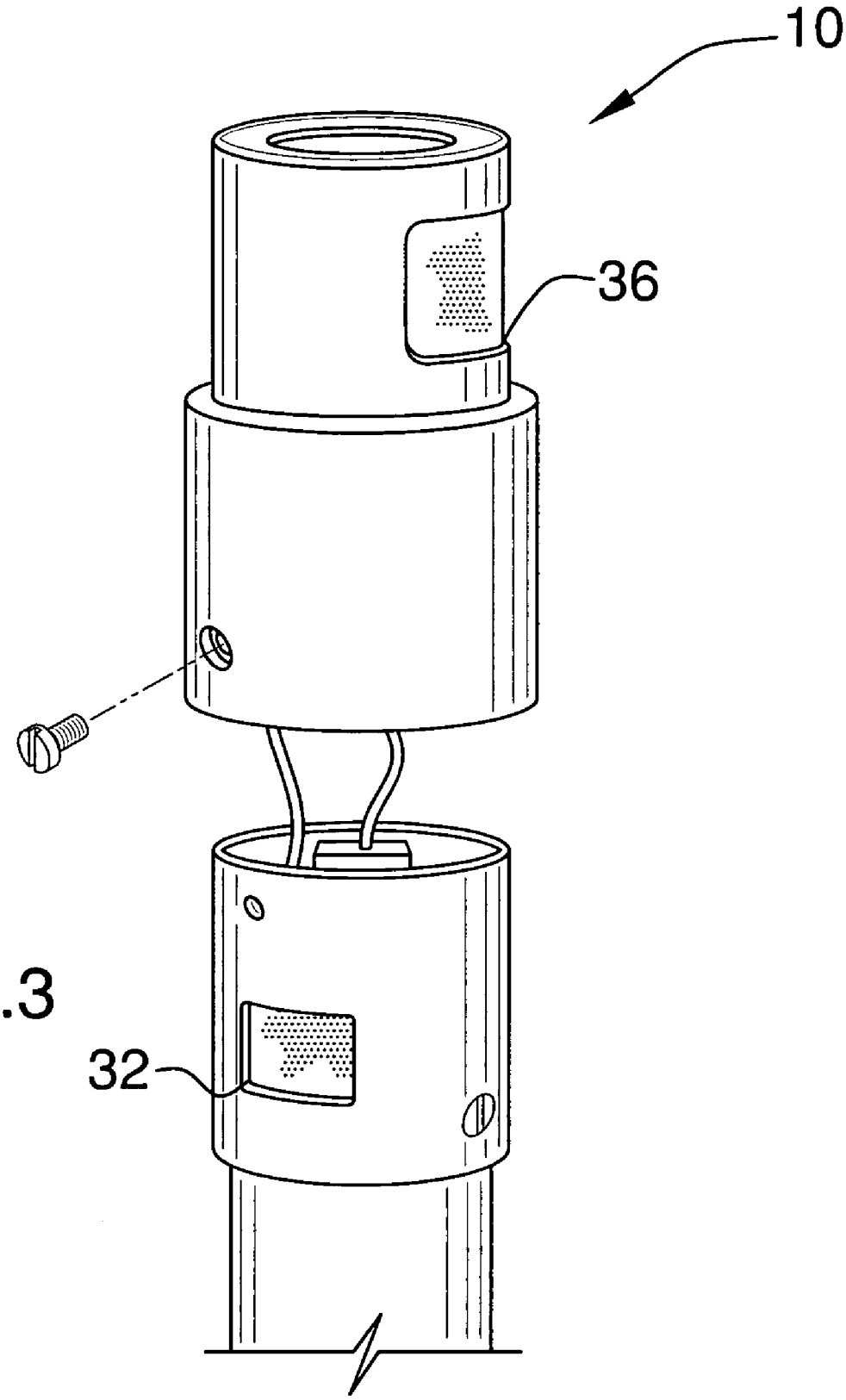
FIG. 3 is a front perspective view of the present invention.
Figure 4:
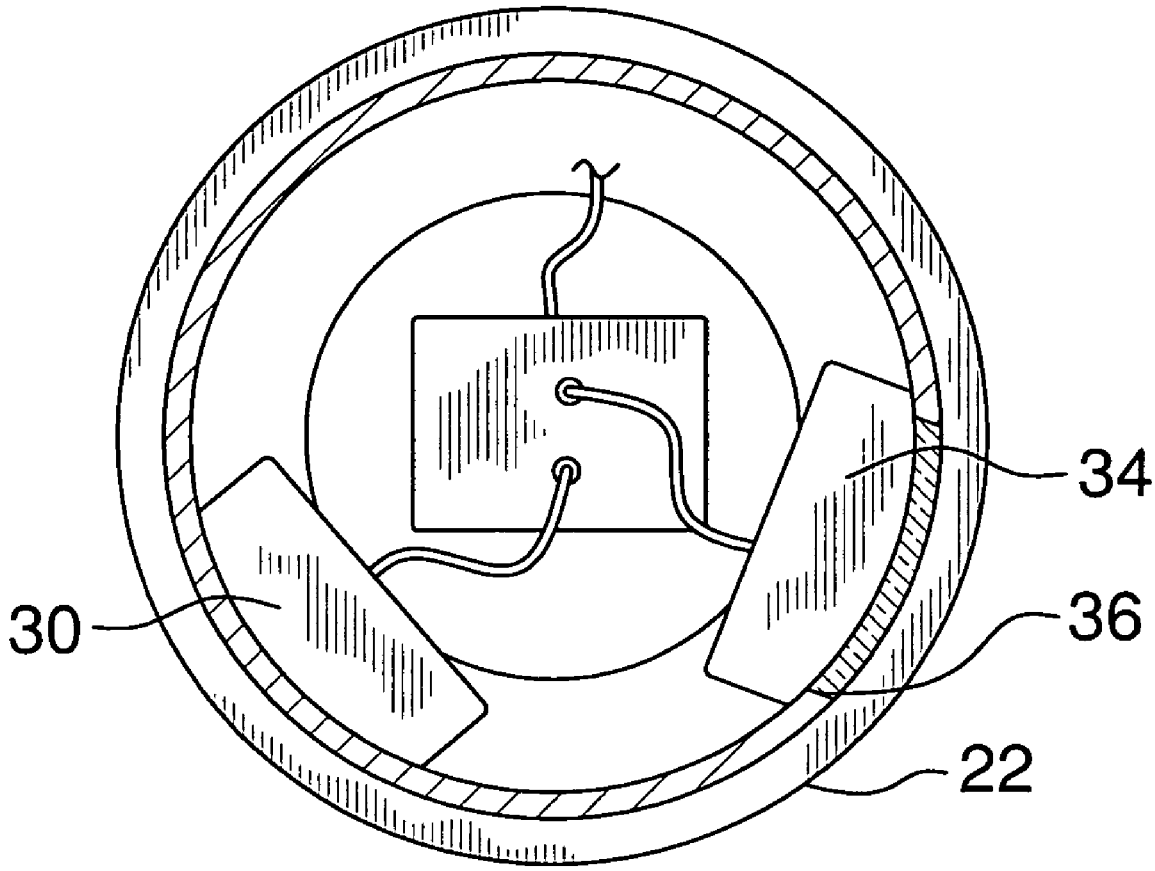
FIG. 4 is a cross-sectional view taken along line 4—4 of FIG. 2 of the present invention.
Figure 5:
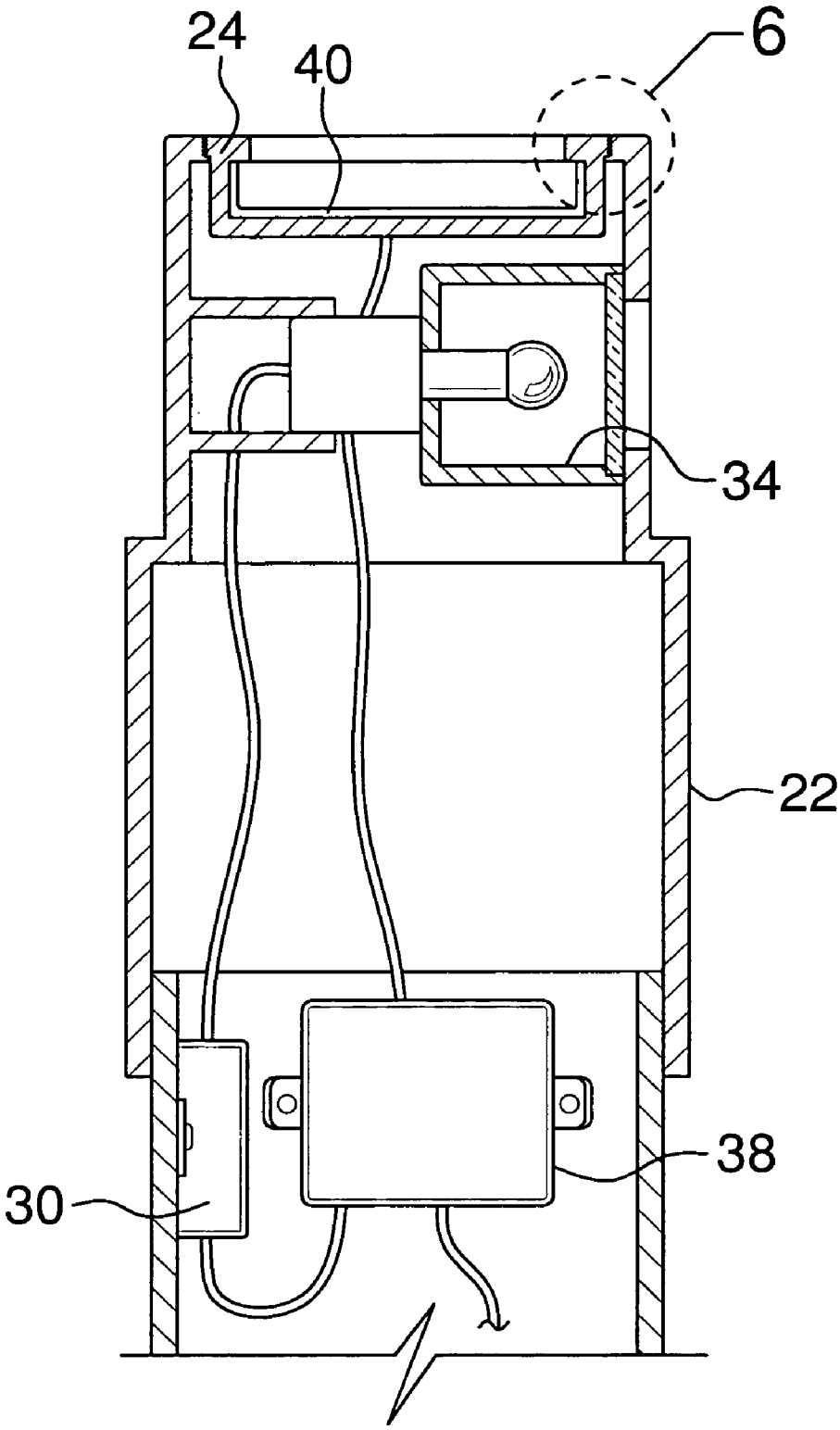
FIG. 5 is a cross-sectional view of the present invention.
Figure 6:
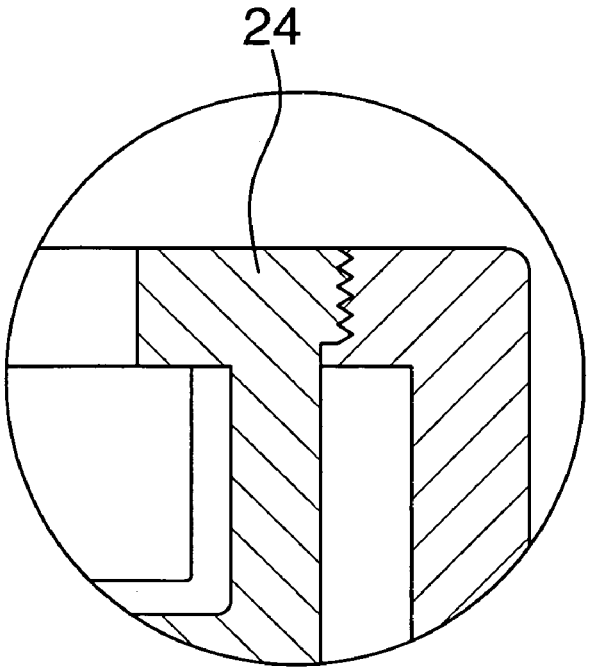
FIG. 6 is an enlarged cross-sectional view of the top wall of the present invention.
Figure 7:
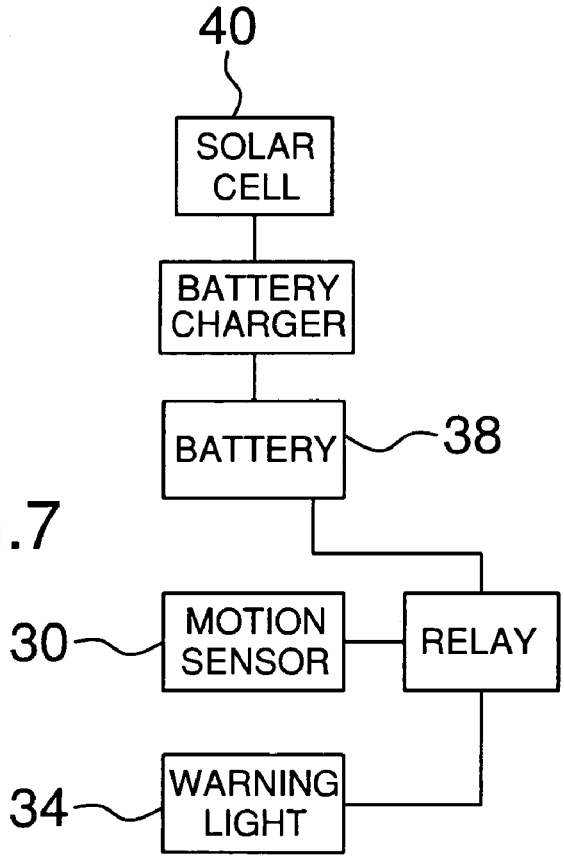
FIG. 7 is an electronic schematic view of the present invention.

With reference now to the drawings, and in particular to FIGS. 1 through 7 thereof, a new warning light device embodying the principles and concepts of the present invention and generally designated by the reference numeral 10 will be described.

As best illustrated in FIGS. 1 through 7, the intersection safety light assembly and method 10 generally comprises a device for warning a driver of a vehicle 11 on a first road 12 of an approaching vehicle 13 on a second road 14 as the approaching vehicle 13 approaches a common intersection 15 of the first 12 and second 14 roads. Wherein the approaching vehicle 13 is approaching the intersection 15 from a blind spot 16 of the intersection 15. The assembly 10 includes a housing 20 that has a peripheral wall 22 and a top wall 24. The housing 20 is mounted adjacent to the intersection 15 and is selectively positionable such that a clear line of sight exists between the housing 20 and the blind spot 16 and between the housing 20 and the first road 12.

A motion detector 30 is mounted on the peripheral wall 22 and is directed toward the blind spot 16. The motion detector 30 is mounted in the housing 20 and is positioned adjacent to and directed outwardly of an opening 32 extending through the peripheral wall 22. A window may positioned in and covering the opening 32. A light emitter 34 is mounted on the peripheral wall 22 and is directed toward the first road 12. The light emitter 34 is electrically coupled to the motion detector 30. The motion detector 30 turns on the light emitter 34 when motion is detected in the blind spot 16. The light emitter 34 is mounted in the housing 20 and is positioned adjacent to and directed outwardly of an aperture 36 extending through the peripheral wall 22. A window may likewise being positioned in and covering the aperture 36.

A power supply 38 is electrically coupled to the motion detector 30. The power supply 38 includes a battery mounted in the housing 20. The top wall 24 of the housing 20 is preferably threadably coupled to the peripheral wall 22 so that it is removable for accessing the battery. The battery is ideally a rechargeable battery. At least one solar cell 40 is mounted on the top wall 24 and is electrically coupled to the battery. The solar cell 40 recharges the battery during daylight hours.

In use, when the driver of vehicle 11 on the first road 12 approaches the intersection 15, the light emitter 34 will signal if there is a vehicle approaching from the blind spot 16. This will signal to the driver on the first road 12 that they should wait until the approaching vehicle 13 passes before proceeding into the intersection 15. That the device 10 is self-contained and powered allows it to be used in rural settings where roads often do not utilize traffic signals and often offer low visibility due to plant growth.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method for warning a driver of a vehicle on a first road of an approaching vehicle on a second road as the approaching vehicle approaches a common intersection of the first and second roads, wherein the approaching vehicle is approaching the intersection from a blind spot, said method comprising the steps of:

providing a housing having a peripheral wall and a top wall, said housing being mounted adjacent to said intersection;

positioning said housing to provide a clear line of sight between the housing and the blind spot and the housing and the first road;

providing a motion detector being mounted on said peripheral wall and being directed toward said blind spot;

providing a light emitter being mounted on said peripheral wall and being directed toward said first road, said light emitter being electrically coupled to said motion detector;

turning on said light emitter by said motion detector when motion is detected in said blind spot; and providing a power supply, said power supply being electrically coupled to said motion detector.

2. The method according to claim 1, wherein said motion detector is mounted in said housing and is positioned adjacent to and directed outwardly an opening extending through said peripheral wall, wherein said light emitter is mounted in said housing and is positioned adjacent to and directed outwardly of an aperture extending through said peripheral wall.

3. The method according to claim 1, wherein said power supply includes a battery mounted in said housing.

4. The method according to claim 3, further providing at least one solar cell being mounted on said top wall and being electrically coupled to said battery.

5. A method for warning a driver of a vehicle on a first road of an approaching vehicle on a second road as the approaching vehicle approaches a common intersection of the first and second roads, wherein the approaching vehicle is approaching the intersection from a blind spot, said method comprising the steps of:

providing a housing having a peripheral wall and a top wall, said housing being mounted adjacent to said intersection;

positioning said housing to provide a clear line of sight between the housing and the blind spot and the housing and the first road;

providing a motion detector being mounted on said peripheral wall and being directed toward said blind spot, said motion detector being mounted in said housing and being positioned adjacent to and directed outwardly an opening extending through said peripheral wall;

providing a light emitter being mounted on said peripheral wall and being directed toward said first road, said light emitter being electrically coupled to said motion detector, said light emitter being mounted in said housing and being positioned adjacent to and directed outwardly of an aperture extending through said peripheral wall;

turning on said light emitter by said motion detector turns when motion is detected in said blind spot;

providing a power supply, said power supply being electrically coupled to said motion detector, said power supply including a battery mounted in said housing; and providing at least one solar cell being mounted on said top wall and being electrically coupled to said battery.

6. A device for warning a driver of a vehicle on a first road of an approaching vehicle on a second road as the approaching vehicle approaches a common intersection of the first and second roads, wherein the approaching vehicle is approaching the intersection from a blind spot, said device comprising:

a housing having a peripheral wall and a top wall, said housing being mounted adjacent to said intersection, said housing being positioned to provide a clear line of sight between the housing and the blind spot and the housing and the first road;

a motion detector being mounted on said peripheral wall and being directed toward said blind spot, said motion detector being mounted in said housing and being positioned adjacent to and directed outwardly an opening extending through said peripheral wall;

a light emitter being mounted on said peripheral wall and being directed toward said first road, said light emitter being electrically coupled to said motion detector, wherein said motion detector turns on said light emitter when motion is detected in said blind spot, said light emitter being mounted in said housing and being positioned adjacent to and directed outwardly of an aperture extending through said peripheral wall;

a power supply, said power supply being electrically coupled to said motion detector, said power supply including a battery mounted in said housing; and at least one solar cell being mounted on said top wall and being electrically coupled to said battery.

* * * * *